United States Patent [19]

Gallis

[11] Patent Number: 4,611,784

[45] Date of Patent: Sep. 16, 1986

[54] SAFETY LOCK FOR JUMP SCAFFOLDING

[75] Inventor: Anthony J. Gallis, Lake Hiawatha, N.J.

[73] Assignee: Harsco Corporation, Camp Hill, Pa.

[21] Appl. No.: 690,156

[22] Filed: Jan. 10, 1985

[51] Int. Cl.[4] ..... E04G 11/06; E04G 11/20

[52] U.S. Cl. ..... 249/20; 182/82; 248/235; 249/219 R

[58] Field of Search ..... 249/20, 21, 22, 19, 249/219 R; 24/16 R; 248/235 X; 182/82

[56] References Cited

U.S. PATENT DOCUMENTS

| | | | |
|---|---|---|---|
| 427,180 | 6/1890 | MacLaurin | 403/49 |
| 2,244,374 | 6/1941 | Riblet | 182/146 |
| 2,555,782 | 6/1951 | Brownstein | 52/637 |
| 2,845,307 | 7/1958 | Holmes | 403/49 |
| 2,854,291 | 9/1958 | Riblet | 182/87 |
| 2,916,245 | 12/1959 | Williams | 248/242 |
| 3,070,337 | 12/1962 | Gates | 182/87 |
| 3,158,225 | 11/1964 | Almgren | 182/87 |
| 3,472,477 | 10/1969 | Juhl | 249/219 R |
| 3,583,666 | 6/1971 | Horstketter | 249/10 |
| 3,588,026 | 6/1971 | Williams | 249/10 |
| 3,591,123 | 7/1971 | Edwards | 249/10 |
| 3,606,237 | 9/1971 | Stephens | 249/20 |
| 3,674,234 | 7/1972 | Davin | 249/219 R |
| 3,957,240 | 5/1976 | Johansson | 248/235 |
| 4,016,228 | 4/1977 | Schmidt | 264/33 |
| 4,060,358 | 11/1977 | Fougea | 425/65 |
| 4,290,576 | 9/1981 | Schworer | 249/20 |
| 4,401,334 | 8/1983 | Kraeling, Jr. | 294/83 |
| 4,452,336 | 6/1984 | Sickler | 248/235 |
| 4,509,711 | 4/1985 | Wallther | 248/235 |

FOREIGN PATENT DOCUMENTS

| | | | |
|---|---|---|---|
| 2445383 | 8/1976 | Fed. Rep. of Germany | 249/20 |
| 231089 | 3/1969 | U.S.S.R. . | |

OTHER PUBLICATIONS

Steidle publication, undated; pp. 27–29, 55–66.

Doka-Normteile publication, undated; pp. 403–1 to 406–1, 408–1 to 419–1, and 421–1 to 426–1.

Hunnebeck GmbH publication, publication date unknown (individual pages are dated), pp. 2–11.

PERI publication, one unnumbered page, pp. 21–23 and 26–27.

ACROW publication, Feb. 1977, table of contents, pp. 2–7 and four unnumbered pages.

*Primary Examiner*—Willard E. Hoag

*Attorney, Agent, or Firm*—Curtis, Morris & Safford

[57] ABSTRACT

A method and apparatus for forming poured concrete walls using crane-lifted type jump scaffolding optionally including associated wallforms, and particularly including a unique automatic safety lock system keyed to the lifting operation to anchor and secure the scaffolding to the previously poured shearwall. This latching system allows for safe and efficient placement of the scaffolding and eliminates the need to have workmen present on unlocked scaffolding, and especially removes the reason for workmen to be tempted to ride the scaffolding while it is being lifted.

14 Claims, 8 Drawing Figures

32
34b"
9b"
7
20b"
34a
16a
17"
45a
46a
9a
17"
16b"
20a
44a
14a
42a
8a
18
17"
24(a)
18
36
34b'
16b'
17"
56a
34b
20b'
26
22a
58a
30a
50a
54a
28
10a
62a
74
74
9b
28
52a
48a
14b'
11a
14b
64a
20b
60a
74
8b
24b
70a
15a
56b
24b'
66a
58b
22b
38a
54b
10b
30b
40a
74
48b
74
94
28
72a
62b
11b
64b
66a
74
60b

SAFETY LOCK FOR JUMP SCAFFOLDING

FIELD OF THE INVENTION

The present invention relates to method and apparatus for safety locking jump scaffolding (typically crane-lifted) used in connection with poured concrete walls. Such scaffolding usually also incorporates integral wallforms used in the incremental construction of poured concrete walls. More particularly, the invention relates to a safety lock for securing such jump scaffolding and wallform combinations to anchor brackets secured to concrete walls.

BACKGROUND OF THE INVENTION

Concrete wallforming by means of vertical jump scaffolding is relatively old in the art. See U.S. Pat. Nos. 3,472,477 and 3,583,666 (which are incorporated herein by reference).

In concrete wall construction, the wallform typically is assembled at a job site. Even today these forms are often custom-built from wooden studs sheathed with plywood for one-time use. Advantageously, on larger construction sites, reusable mobile wallforms are used, typically ganged together and shifted as the height and length of the concrete wall is formed.

The combination ganged wallform and jump scaffold are lifted into place by a crane and affixed to the previously poured wall section by anchor brackets secured to anchors or tie rods set in the concrete.

The convention in the art for affixing the jump scaffolding has been to manually bolt them to the wall section. An alternative method is to use hooks or tapered slots, both of which require hand-placed safety retaining pins.

These methods can all be dangerous to the workmen who are required to remove and reset locks by hand from scaffolding which is thereafter vulnerable to dislodging by wind, etc. even though personnel are still on it. Such workmen are tempted to ride the crane-lifted scaffolding and remain in that precarious position while they bolt the scaffolding to the wall in the new position. The potential for accident or serious injury to the workmen from wind gusts or crane malfunction is self-evident.

Typically, jump scaffolding has been specially designed and difficult to adapt to different applications. They are commonly constructed of heavy lumber, and more recently, of heavy steel, and are rigidly welded or bolted together. A change in size or design requirements necessitates time consuming and extensive cutting, bolting, and welding. Often the old scaffolding from a former job has to be substantially scrapped and most of it rebuilt anew, requiring a majority of new materials.

Once the second pouring is complete and has cured, the scaffolding/wallform combination is lifted by crane onto the next higher set of mounting bolts. At this point a trailing platform is usually attached beneath the scaffolding to provide a working level for removing the mounting brackets or bolts and to install wind tie-backs. These wind tie-backs prevent the scaffolding from putting excess shear force on the mounting wall from wind gusts. The trailing platform also provides a level from which preliminary finishing of the concrete can be done.

A working platform at the top of the wallform provides a level for workmen to install the next set of anchors and mounting bolts as well as rebar and block-outs, etc.

In this fashion the wallform/scaffolding combination is used to incrementally create a wall of the desired height, many stories high.

OBJECTS OF THE INVENTION

Accordingly, it is an object of this invention to provide an automatic latching system for jump scaffolding which does not require workmen to work on unsecured scaffolding nor to ride the scaffolding into position.

Additionally, it is an object of this invention to provide a jump scaffolding system incorporating standard aluminum beams and avoiding the drawbacks of prior jump scaffolding systems.

BRIEF DESCRIPTION OF THE DRAWINGS

In this specification and the accompanying drawings, applicant has shown and described several preferred embodiments of his invention and has suggested various alternatives and modifications thereto, but it is to be understood that these are not intended to be exhaustive and that many changes and modifications can be made within the scope of the invention. These suggestions herein are selected and included for purposes of illustration in order that others skilled in the art will more fully understand the invention and principles thereof and will thus be enabled to modify it and embody it in a variety of forms, each as may be best suited to the conditions of a particular use.

SUMMARY OF THE INVENTION

Applicant has conceived the unique idea of utilizing the lifting action of the crane to unlatch his remote-acting safety lock from the anchor wall brackets by which the wallform-jump scaffolding combination is secured to the poured concrete wall. The T-shaped anchor is also specially designed to be free of welds and castings and thus be doubly safe.

In a prepared embodiment the crane lifts the stripped-back wallform, thus pulling up on each of the swivel gang jacks. Each jack will most commonly have a safety lock associated therewith. These jacks in turn lift the connector bolt in a vertical slot in the safety lock's support frame causing the safety catch assembly to rotate the catching bail away from its locking position under the base of the anchor wall bracket. The connector bolt continues to be lifted and next engages the top of the vertical slot and commences thereby to lift the lock's support frame and thus all the scaffolding and the wallform attached thereto. Consequently, the connector bolt lifts out of the hook notch in the anchor wall bracket.

When the crane puts the connector bolt into the hook notch of the next higher anchor wall bracket, the foregoing process is reversed. The safety lock can be actuated by the lifting action of lifting devices essentially equivalent to a crane, such as the winch device shown in such self-climbing scaffolding as disclosed in U.S. Pat. No. 4,060,358, see also, U.S. Pat. No. 4,290,576 and Peri self-climbing scaffold model KGF-S.

DETAILED DESCRIPTION OF THE PREFERRED EMBODIMENTS

Figure 1:
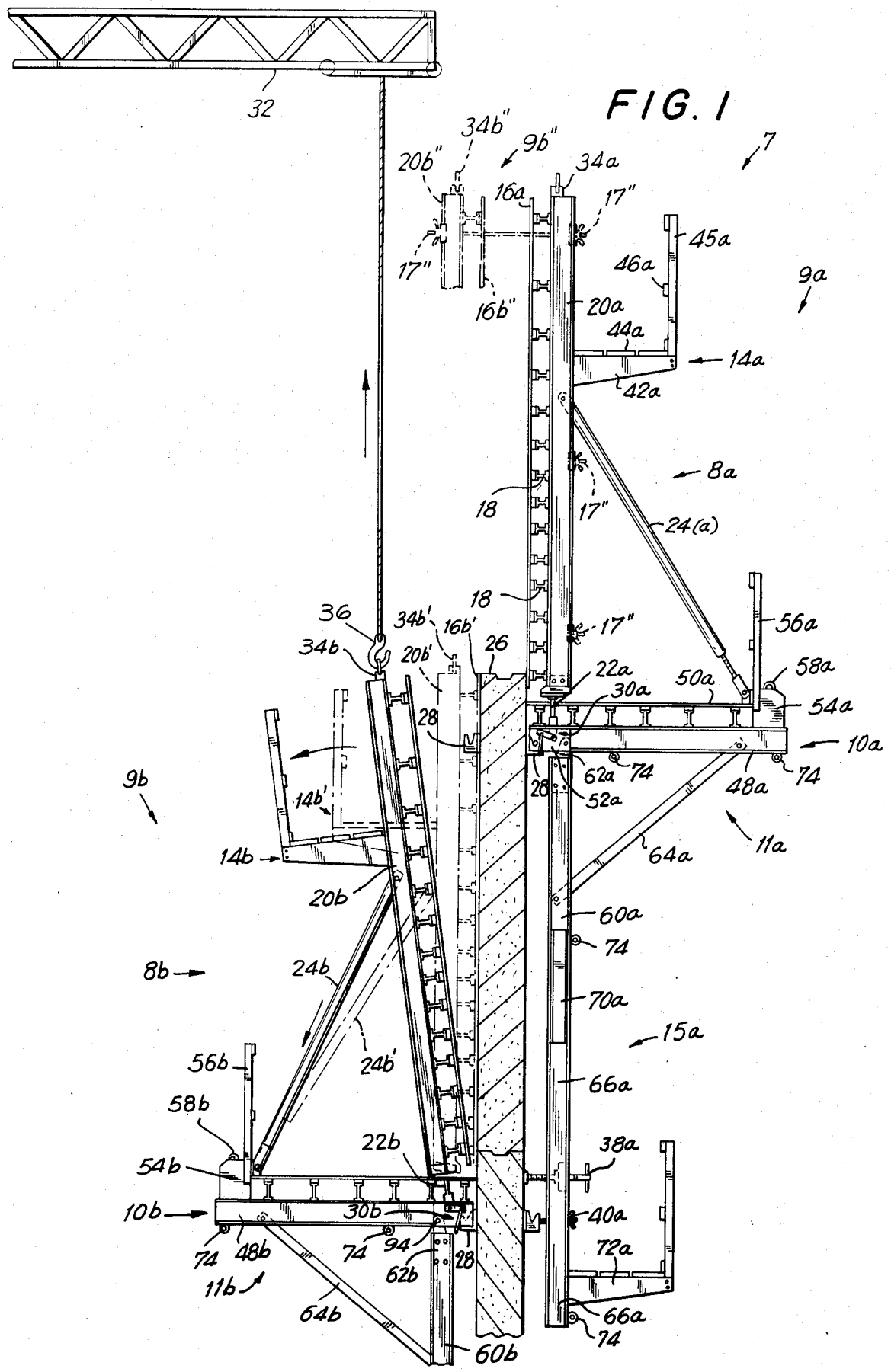
FIG. 1 is a partially diagrammatic side elevational view of a pair of jump scaffolding-wallform combinations constituting a system incorporating a preferred embodiment of the present invention. The first jump scaffolding-wallform combination on the right side is shown anchored on the top of a poured concrete wall in position for receiving the next incremental pour of concrete to extend the concrete wall upwardly. The second combination on the left is shown still in the lower position (with the wallform stripped back from the first position shown in phantom outline). The crane is shown initiating lifting thereof for moving into the next raised and parallel position opposite the first combination. The latter raised position of said second combination is partially shown in phantom outline.

In FIG. 1 is illustrated a jump scaffolding system (7) comprised of two facing wallform-jump scaffolding combinations (9). Each combination, preferably, includes a scaffolding bracket (11), an attached upper wallform (8), and a trailing scaffold (15). For convenience of reference, the combination (9*a*) is mounted on the right of the wall (26), and all its parts will be identified by the letter "a" in the reference numerals, and the identical parts in combination (9*b*) will be identified by the letter "b".

The system typically operates in multiple pairs with one unit (9*a*) of each pair forming the inside of the wall and the other facing unit (9*b*), directly opposite, forming the outside of the wall (26). This system forms vertical shear walls in increments by jumping the scaffolding up the wall and affixing the tops of each scaffolding bracket 11 [via support bolts (92)] to anchors (28) affixed near the top of the previously poured and cured wall (26), whereby the bottom of the wallform engages the top of said wall (26). The novel process and apparatus by which this system safely climbs the shear wall is discussed in greater detail below.

FIG. 1 represents the actual climbing process in sequence. The left portion shows a jump scaffold unit (11*b*) with its integral wallform (8*b*) stripped away from the cured wall. This wallform (8*b*′) is shown in phantom outline in the pre-stripped pouring position. The components shown in this phantom outline position are distinguished by the use of a prime (′) in conjunction with the reference numbers. The scaffold unit (11*b*) remains securely suspended from the wall (26) by means of a unique anchor bracket (28) and safety lock (29).

Figure 2:
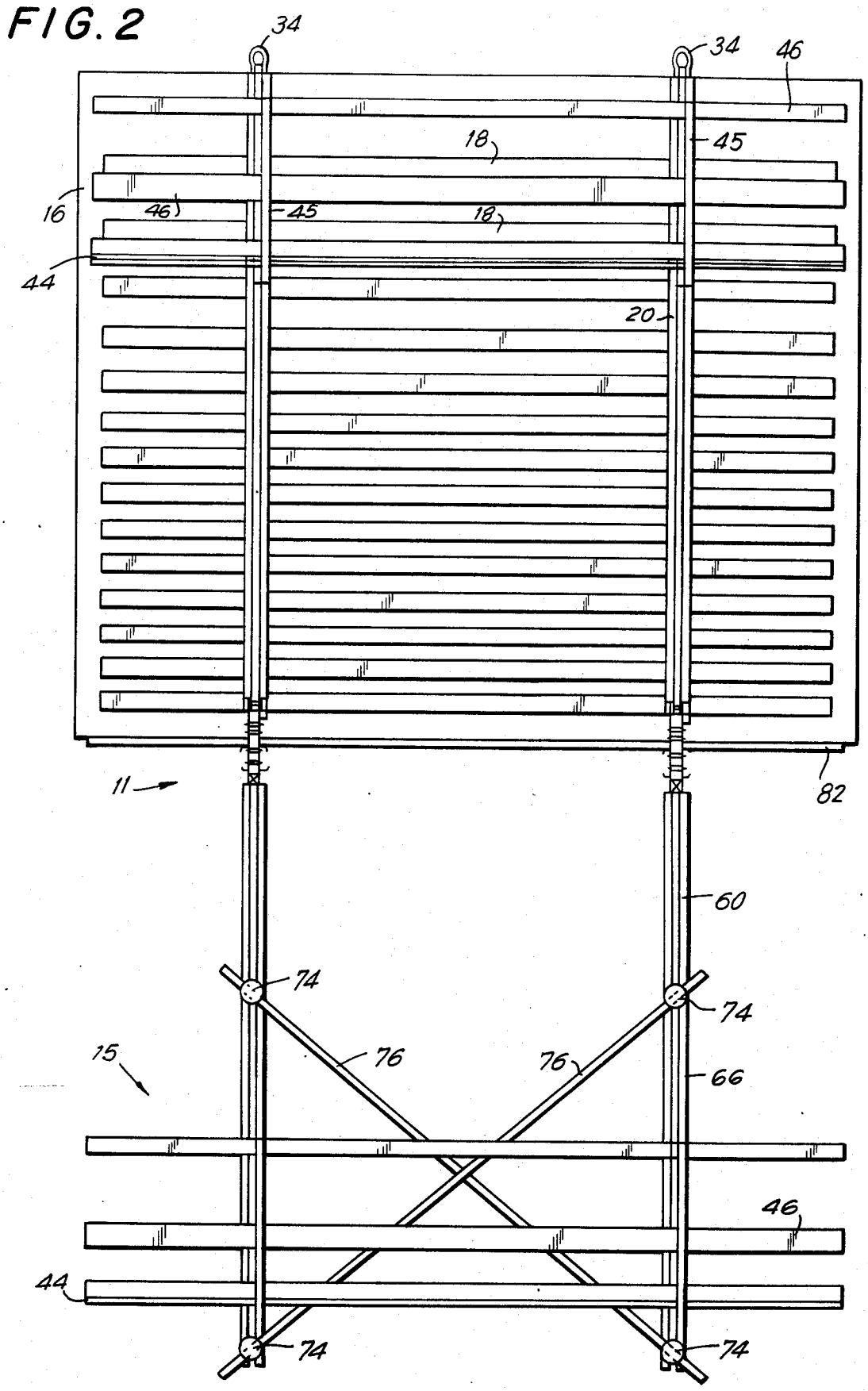
FIG. 2 is a partially diagrammatic rear elevational view of a slightly modified jump scaffold unit (also including an integral upper wallform and trailing platform).
Figure 3:
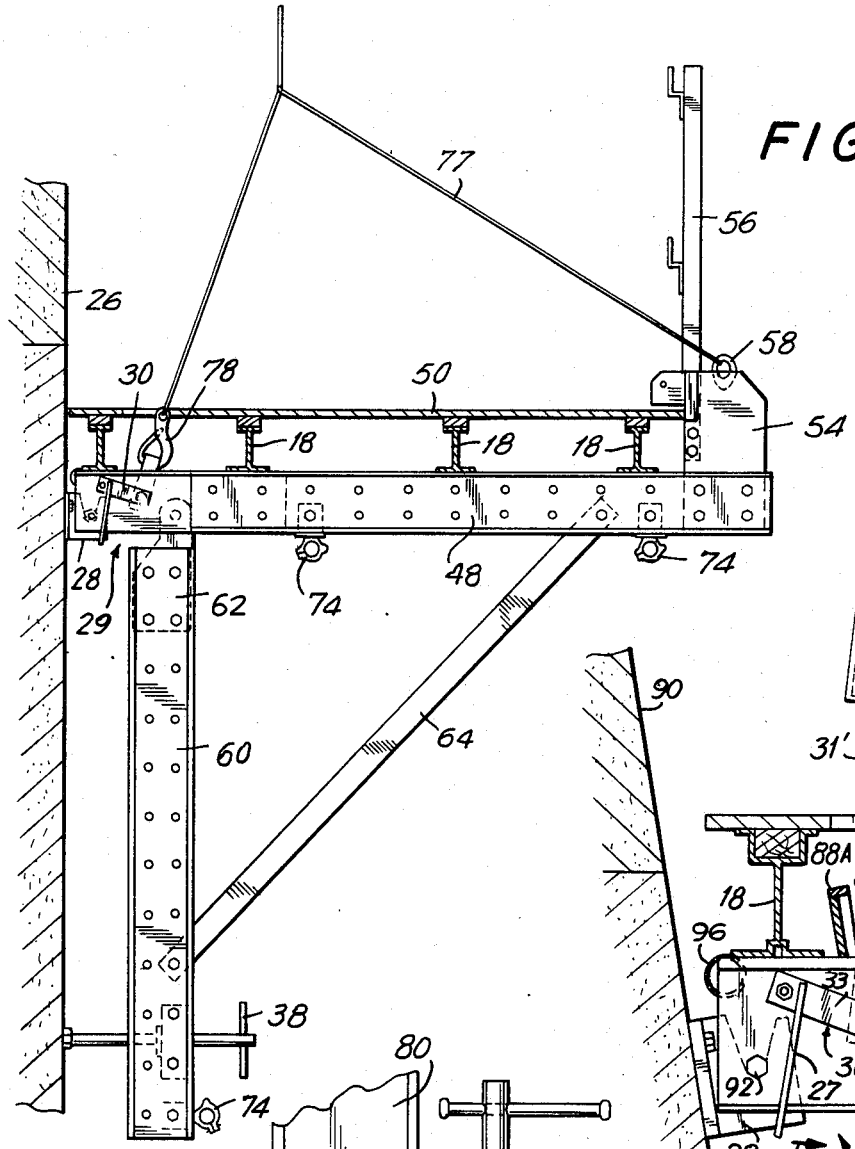
FIG. 3 is a side elevational view of a still further modification showing a jump scaffolding unit used alone (with no integral wallform or a trailing platform), and also showing a crane lift-bridle clipped onto the lift link of the safety catch assembly embodying the invention.
Figure 4:
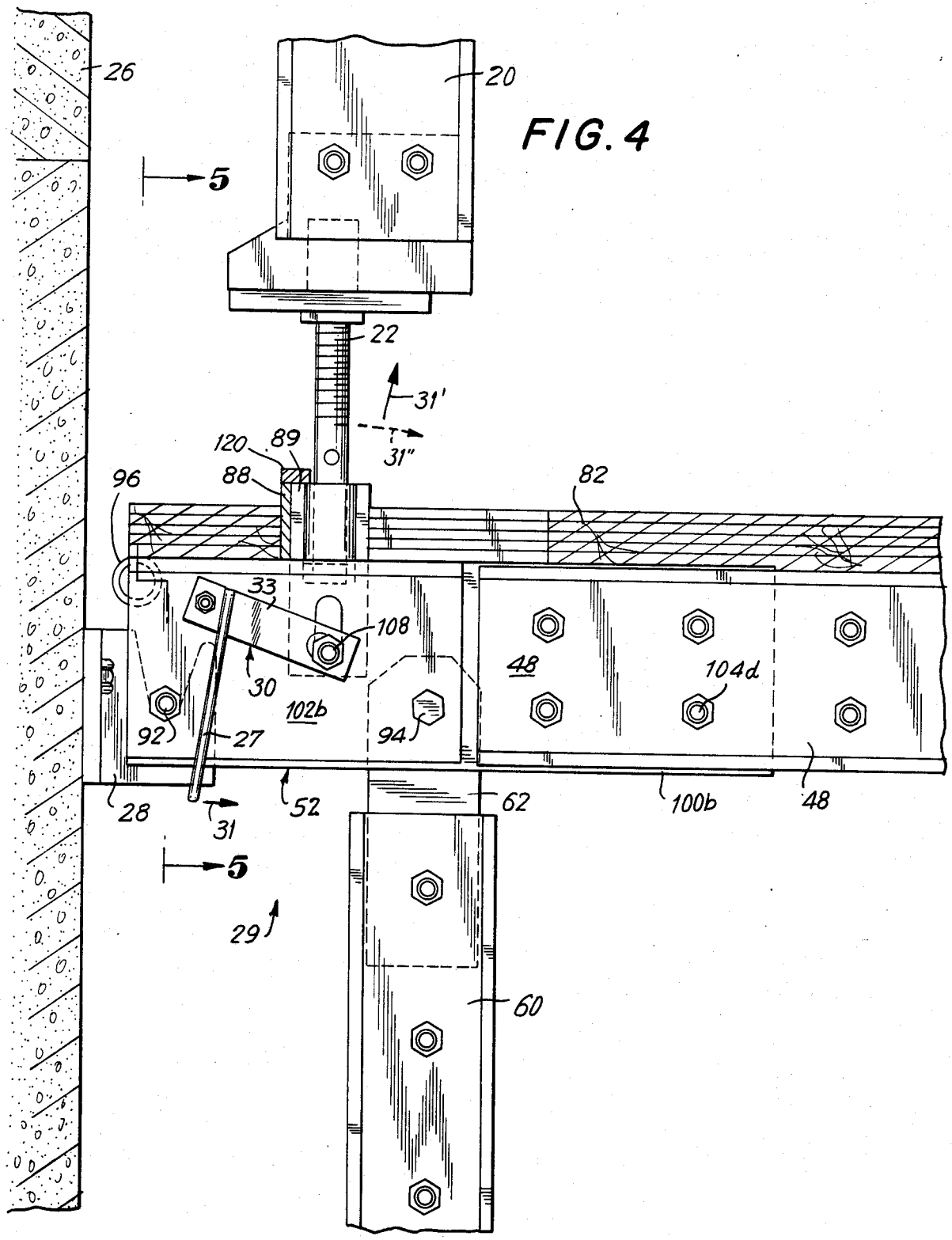
FIG. 4 is a detailed side elevational view of the jump scaffolding unit in FIG. 2 showing the safety lock and the integrally attached wallform in the pour position (with the swivel gang jack engaging the uplift stop).

The wallform (8*b*) is rigidly supported in the stripped position by at least two adjustable pipe braces (24*b*) (one shown) connecting the wallform (8*b*) with the platform (10*b*) of the scaffold unit (11*b*). Jumping is accomplished by crane (32). The crane hook (36) engages two lifting lugs (34) (shown more clearly in FIG. 2) and lifts the weight of the entire wallform and scaffolding combination (9*b*) from the anchor brackets (28). In so doing the unique safety catch assembly (30*b*) automatically disengages from the anchor bracket (28). See arrows 31, 31′, and 31″ in FIGS. 3 and 4, showing how the safety catch assembly (30) [comprised of a "hooking" bail (27) and pivot straps (33)] are rotated so as to "unlock" the bail (27) from under the anchor bracket (28). See the safety catch assembly (30*b*) in FIG. 1, which is shown in the unlocked position, with the wallform (8*b*) already slightly lifted by crane (32) and with the scaffold unit (11*b*) ready to be lifted. All other figures show the safety catch assembly (30) in the locked position [with the bail (27) looped under the bracket (28)].

With the safety catch assembly (30*b*) unlocked, as shown, the unit (9*b*) is free to be removed from the wall (26) and jumped by the crane (32) to the next pouring position. The crane (32) then settles the unit (9*b*) into the upper position such that the support bolt (92*b*) and safety lock (29*b*) again engage the uppermost wall-mounted anchor brackets (28). As the weight of the unit (9*b*) is shifted from the crane (32) to such upper anchor brackets (28), the safety lock (29*b*) automatically and securely engages the upper anchor bracket (28) to lock and maintain the unit (9*b*) in position. This fully automatic jumping process is entirely unique in the field and is both safer and more efficient than any known methods in use today.

Once hung in position from the anchor brackets (28) the crane hook (36) is disengaged from the lifting lug (34). A waler standoff jack (38) is provided, as shown in the right portion of FIG. 1, to plumb the assembly. Once plumb, anchor ties (40) are tightened and the wallform (8*b*) is ready to be positioned for the pour. The adjustable pipe braces (24*b*) are extended causing the wallform (8*b*) to pivot forward (from the position similar to that shown in FIG. 3A) to the pouring position [partially shown in dash-dot outline and identified in this new position by reference numbers having a double prime (″)]. This operation also causes a further novel safety mechanism to be engaged. This uplift stop mechanism (88) engages the shoulder (89) of the swivel gang jack (22) when the integral wallform (8) pivots fully forward (shown in more detail in FIG. 4). This prevents any accidental lifting of the unit while in the pour position. Concrete anchors (not shown) and tie rods (17″) are then secured into place between the inside wallform (8*b*) and the outside wallform (8*a*). The system is then prepared for the pour. The right portion of FIG. 1 shows the outside wall unit suspended in a secured position ready to accept the pour.

The wallform (8*a*) and (8*b*) is of standard construction with a sheathing panel (16) made up of common ¾" plywood sheets. Support for the panel is provided by a system of parallel modified aluminum I-beam top-hat joists (18) with nailer strips (19) commonly used in the construction industry. These joists (18) are connected to walers (20). The walers (20) are of standard double channel (8") aluminum construction and run perpendicular to the joists (18) as depicted in FIG. 2. Mounted to the upper portion of the wallform (8) is a working platform (14) used as a base for installing new anchor brackets and preparing the system for the concrete pour. This platform (14) is supported by at least two scaffold brackets (42) across which planking (44) is placed. For safety, guard rail posts (45) with rails (46) are positioned at the edge of the platform (14).

The wallform (8) is pivotally attached to the main scaffold platform (10) by means of a swivel gang jack (22). The wallform (8) is further connected to the platform (10) by a diagonally placed adjustable pipe brace (24) running from a post brace and lift plate assembly (54) to the wallform waler (20).

Figure 3A:
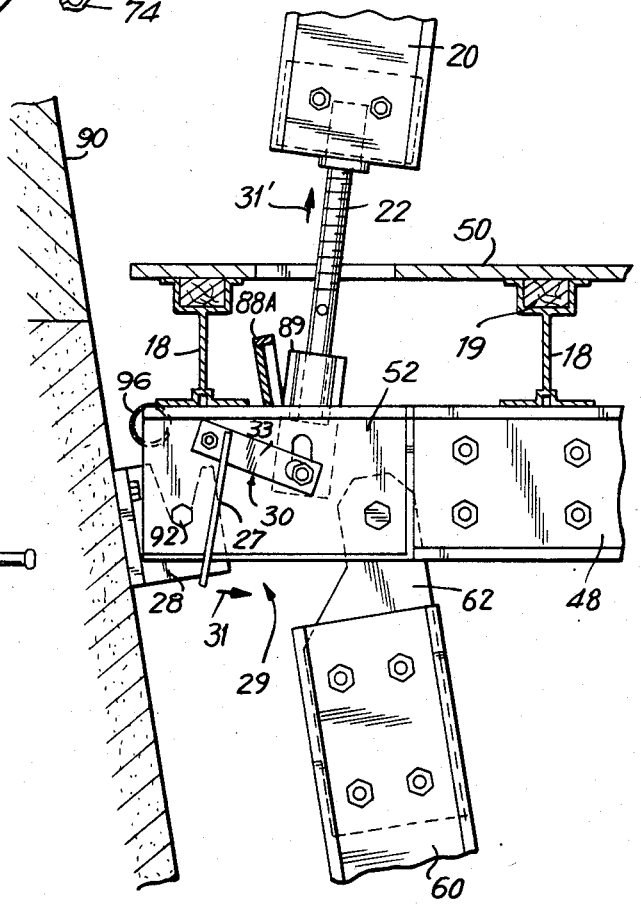
FIG. 3A is a detailed side elevational view, partially sectioned, of the jump scaffold unit with integral wallform shown in FIG. 1, but mounted on a battered wall (i.e. a wall with a slanting face) and more clearly showing the unique safety lock embodying the present invention. This lock is shown engaging the hook wall anchor bracket, but with the wallform and attached swivel gang jack swung to the right into the stripped position thus disengaging the uplift stop.

The main scaffold platform (10) is unique in that it is constructed using standard double channel (8") aluminum walers (48) as beams supporting a plywood working platform (82) (see FIGS. 2, 3B, 4 and 5) or by joists (18) supporting plywood flooring (50) (see FIGS. 1, 3 and 3A). A support frame (52) is securely fastened to the ends of the walers (48) adapted to be functionally adjacent to the wall (26). This support frame (52) carries the unique safety catch assembly (30) and the uplift stop (88) clearly depicted in FIGS. 5 and 6. These function as a unit as the unique self-actuating safety lock (29). This will be discussed in more detail below.

This construction of the main scaffold platform (10) is beneficial in that it can be quickly and easily assembled and modified using standard waler sections and splice plates. When no longer needed, such components have other uses. The aluminum and plywood components also result in a much lighter and more manageable unit when compared with the rigid tubular steel construction typically in use today.

Two post brace and lift plate assemblies (54) are secured to the ends of the support walers (48) opposite the platform beam brackets (52). These provide anchors for the guard rail posts (56) and, in the alternate embodiment shown in FIG. 3, they are fitted with a lifting lug (58) for use when a wallform is not used therewith (or is used independently, see FIG. 3B).

Another set of standard walers (60) extend perpendicularly downwardly beneath the support walers (48). They are advantageously moveably attached to the lock support frame (52) by means of a pivot bolt (94) and a standard pivot plate (62). See FIG. 4. These walers (60) hang substantially parallel to the face of the wall (26). A diagonal brace (64) running from each trailing waler (60) diagonally up to each platform beam waler (48) provides further support to the platform (10).

Suspended from the trailing walers (60) is a trailing platform (15). This platform includes standard double 8" aluminum walers (66) firmly affixed to the trailing walers (60) by means of aluminum splice plates (70). Scaffold brackets (72) are fixed perpendicular to the trailing platform waler (66). The remainder of the working platform (15) is constructed substantially the same as the wallform working platform (14) previously described. The trailing platform walers (66) are further diagonally cross-braced using cross bracing couplers (74) and standard pipe bracing (76). This cross bracing is clearly shown in FIG. 2.

FIG. 3 shows another preferred embodiment wherein the same jump scaffolding unit (11) is utilized without an integral wallform. This embodiment is useful in finishing or repair work on shear wall facades where no concrete pouring is contemplated. The construction of this embodiment is substantially the same as that previously described with the exception that the swivel gang jack (22) and wallform (8) are not used. Jumping this embodiment is accomplished in essentially the same fashion. One end of a lifting bridle (77) with a clip lock (78) is attached directly to the safety lock (29) and the other end of the bridle is attached to the post brace and lift plate assembly (54). The operation of the safety lock (29) is substantially the same. As the crane (32) takes the weight of the unit the safety lock (29) automatically disengages from the anchor bracket (28) allowing the entire unit to be moved to any suitable location on the wall (26).

Figure 3B:
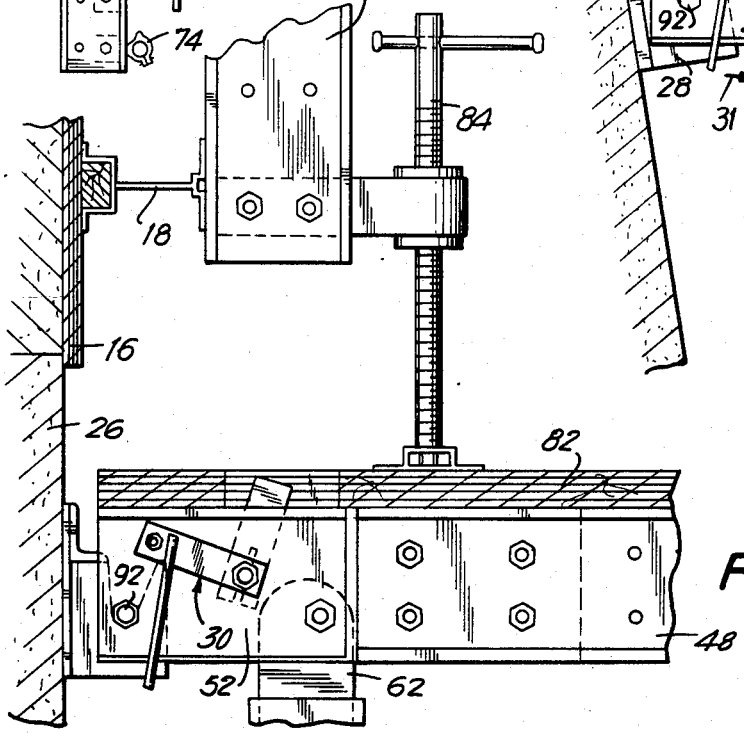
FIG. 3B is a detailed side elevational view of a similar jump scaffold unit with an independent wallform resting thereon and showing a slightly modified safety lock similar to that in FIG. 3.

FIG. 3B shows a non-integral wallform (80) which can be used in conjunction with the embodiment in FIG. 3. The wallform (80), supported by gang jacks (84), simply rests upon a working platform (82) and is secured against the wall (26) by diagonal bracing (not shown) extending from the post brace and lift plate assembly (54) to the wallform (80). The height of the wallform is adjustable through the gang jacks (84) secured to the wallform waler (86).

FIG. 3A is a detailed view of the support frame (52) on a slanting wall showing the safety lock (29), the swivel gang jack (22), a section of the wallform waler (20), the pivot plate (62), the trailing waler (60), the anchor bracket (28), platform joists (18), and the plywood working platform (50). This view shows the integral wallform (8) in the stripped position ready for lifting and further shows the novel safety uplift stop (88) incorporated into the support frame (52). This uplift stop (88) serves to prevent the crane (32) from accidentally lifting the unit when the integral wallform (8) is not in the stripped position. The integral wallform (8) must be physically pivoted beyond this uplift stop (88) in order for the crane to begin lifting the unit. Note that the stop (88A) in FIG. 3A is canted at the same angle as the slanting wall (90), while stop (88) in FIG. 4, is fixed vertically to conform to the vertical wall (26).

Compare FIG. 4 which shows the support frame (52) on a vertical wall (26) with the integral wallform (8) in the pouring position. This figure shows an alternate embodiment for the working platform (wherein plywood sheets (82) are placed directly onto the support beam 48 as in FIGS. 3B and 5). Note that the shoulder 89 of the swivel gang jack (22) affirmatively engages the lip of the uplift stop (88) preventing any accidental lifting of the integral wallform (8). This prevents accidental unlocking of the safety lock (29) from the holding device (i.e. anchor bracket (28).

Figure 5:
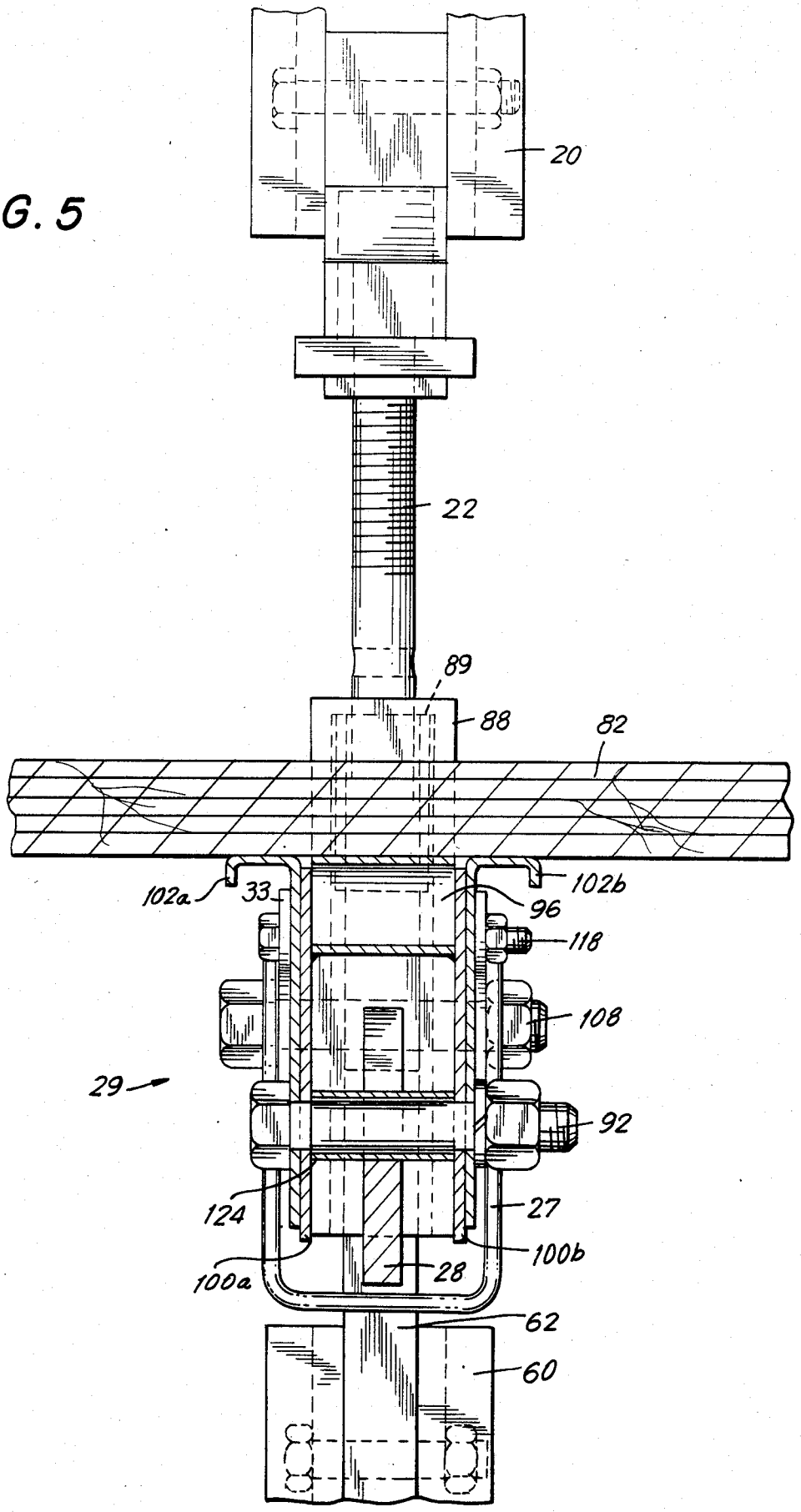
FIG. 5 is a detailed front sectional view of the jump scaffold unit in FIG. 4 taken along line 5—5.

FIG. 5 shows more detail within the support frame (52) of the lock (29) including the support bolt (92), the double wall construction of the support frame (52) and the lift bolt (108).

Figure 6:
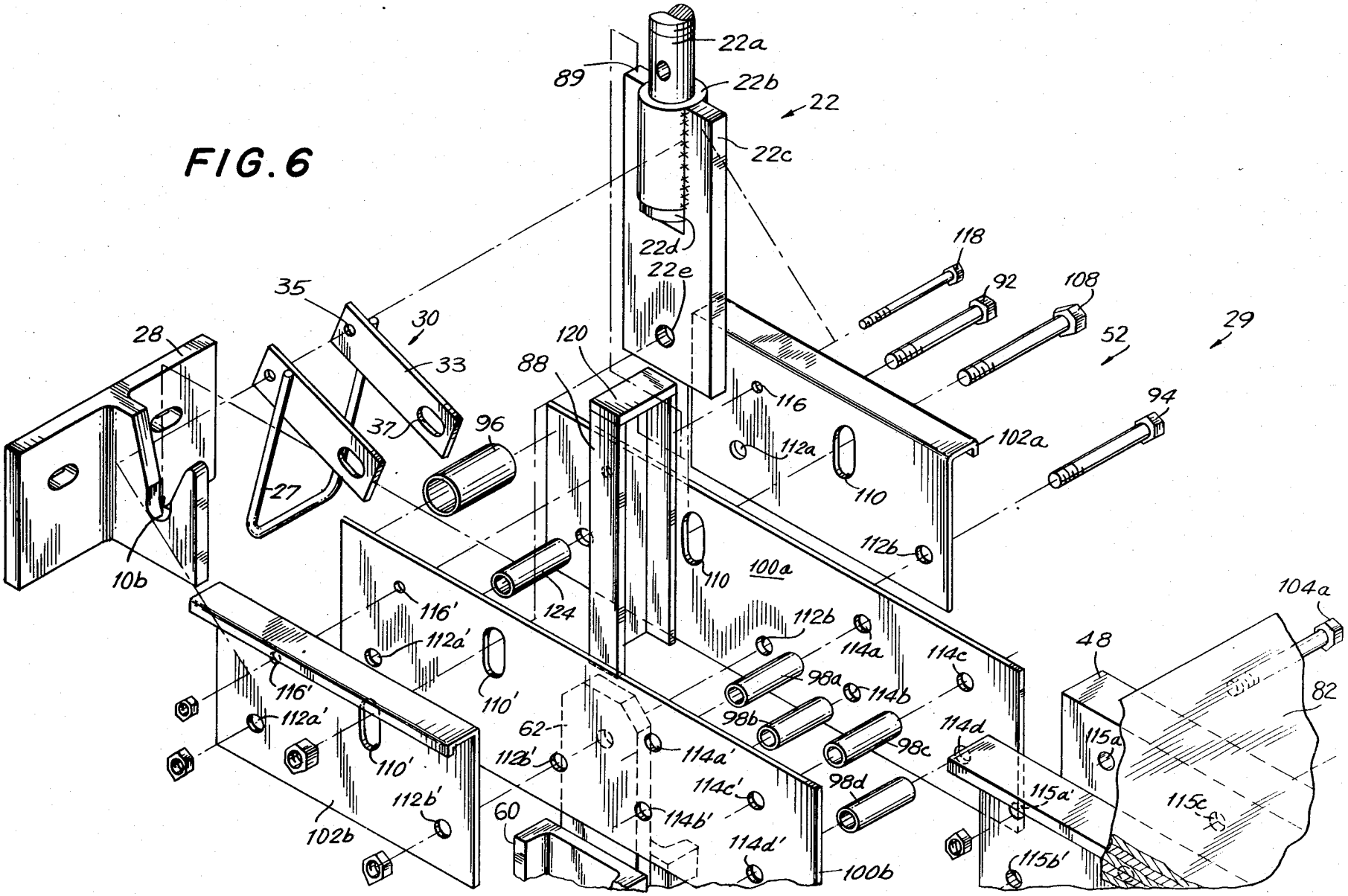
FIG. 6 is a detailed exploded perspective view of the safety lock, including the catch assembly, and its support frame previously shown in FIGS. 4 and 5.

FIG. 6 is a detailed exploded view of the support frame (52) showing the component parts. The sides of the frame (52) are composed of left and right clip plates (102*a*)-(102*b*) welded to the outside of left and right connector plates (100*a*) and (100*b*). The connector plates have 4 holes (114) drilled in a rectangular configuration to align with the corresponding holes (115) in the platform support beam (48) at one end to facilitate bolting the frame (52) to the platform support beam (48) with bolts (104). Two holes (112*a* and *b*) are drilled through the lower half of both the clip plates (102) and the connector plates (100). These holes (112*a* and *a'*) and (112*b* and *b'*) are respectively for the support bolt (92) and the pivot bolt (94). The pivot bolt (94) connects the pivot plate (62) with the support frame (52). The support bolt (92) is adapted to rest in the notch (106) of the anchor bracket (28) and takes at least the substantial portion of the weight of the jump scaffolding unit (and any attached integral wallform, trailing work platform, and the like). A 1½" vertical slot (110) is also cut to accommodate the lift bolt (108). This connector bolt (108) connects the swivel gang jack (22) and the safety catch assembly (30). The bolt (108) is vertically moveable within the vertical slots (110) and in the accommodating horizontal slots (37) in the free ends of pivot straps (33). One hole (116) is drilled through both sides of the support frame (52) to accommodate the safety catch assembly bolt (118). This bolt (118) also engages the pivot holes (35) in the pivot straps (33) and thus provides the pivot point about which the safety catch assembly (30) rotates when moved by the swivel gang jack (22) via the lift bolt (108).

The swivel gang jack (22) comprises a jack screw (22*a*), a collar (22*b*) in which the jack screw freely turns and a plate (22*c*) welded to the collar (22*b*) so as to capture the jackscrew's head (22*d*). Pivot hole (22*e*) in plate (22*c*) receives lift bolt (108). When the crane (32) lifts the wallform and its attached swivel gang jack (22), the lift bolt (108) positioned in the jack plate hole (22*e*) is also raised, carrying with it the pivot straps (33) of the safety catch assembly (30), thus unlocking the scaffolding unit (11) by swinging the attached bail (27) out from under the projecting hook portion of the anchor bracket (28). The vertical slots (110) are long enough to permit the bail (27) to be free of the bracket (28) before the lift bolt (108) engages the top of the slots (110) and begins to lift the unit (11) free of the anchor bracket (28).

Also clearly indicated in FIG. 6 is the uplift stop (88). When the integral wallform (8) is in the upright pour position (as shown in FIG. 4) the top plate (120) of the uplift stop (88) acts to prevent the shoulder (89) of the swivel gang jack (22) from raising and thereby disengaging the safety catch assembly (30).

Welded between the plates adjacent to the bracket holes (114) are 3" pipe spacers (98). These spacers maintain the plates at a fixed distance apart and provide internal support for the support frame (52). A further support bolt spacer (124) is welded in alignment with holes (112*a*) and (112*a'*). This spacer (124) also provides support and further prevents damage or wear to the support bolt (92).

A standoff spacer (96) is positioned as shown in FIGS. 4 and 6 to provide both support to the frame (52) and to hold the frame (52) slightly away from the wall to facilitate proper placement of the support bolt (92) into the anchor bracket notch (106) during the jumping operation.

What is claimed is:

1. A self-actuating safety lock mountable on crane-liftable jump scaffolding for securing the latter to a projecting anchor affixed to the side of a poured concrete wall, comprising a support frame for said lock mountable on said jump scaffolding such that said lock is engagable with said anchor to position and support said scaffolding on said wall, engaging means mounted on said frame for interacting with said projecting anchor in a relative hooking support, a safety catch assembly being pivotally mounted on said frame to lockingly catch said projecting anchor in the at-rest position to prevent unhooking of said engaging means from said anchor and being pivotally rotatable to a lifted unlocked position, a lift connector attached to said safety catch assembly at a point offset from the pivot axis of the latter such that an upward lift derived from said crane acting on said connector rotates said assembly to its unlocked position, and fastening means for mounting said lock to said scaffolding.

2. A device according to claim 1, further comprising said safety catch assembly having a parallel pair of generally horizontally disposed levers commonly pivoted at their proximal end, relative to the concrete wall, about an axis parallel to the face of said wall near the proximal end of said support frame; each lever having a longitudinal slot in its distal end; a generally U-shaped bail with each one of its two free ends being fixed to a respective lever at a point relatively close to but equally distal from said pivot axis such that said bail depends generally downwardly and extends between said levers, said support frame having at least one vertical slot positioned to overlap the longitudinal slots in said levers, said lift connector comprises a transversely mounted lift bolt simultaneously positioned in said vertical and horizontal slots, said vertical slot being dimensioned such that with said bolt in the at-rest position in the bottom of said vertical slot said bail is pivoted outwardly in the proximal direction to lock the engaging means onto any anchor supportively interacting therewith and such that with the lift connector bolt in lift position at the top of said vertical slot said bail is pivoted inwardly in the distal direction to unlock the engaging means.

3. A device according to claim 2, wherein said lift connector further comprises a swivel gang jack means for securing to, supporting, and vertically adjusting a ganged wallform positioned to extend above said safety lock, said swivel gang jack means being pivotally mounted on said lift bolt.

4. A device according to claim 3, further comprising an uplift stop means for engaging said swivel gang jack means when a wallform attached thereto is in the pour position so as to retain said lift bolt low in said vertical slot thereby fixing the safety catch assembly in the locking position and for disengaging said swivel gang jack means when the latter is rotated away from the uplift stop means by stripping the wallform back from the pour position.

5. A device according to claim 2, wherein said support frame comprises at least a pair of spaced, parallel, longitudinally-extending plates fixed relative to one another with each plate having one of said vertical slots.

6. A device according to claim 5, wherein said engaging means is a support bolt extending between said support frame plates at the proximal end thereof, said support bolt being positioned to engage an upwardly open hook anchor.

7. A device according to claim 4, wherein said support frame comprises at least a pair of spaced, parallel, longitudinally-extending plates fixed relative to one another with each plate having one of said vertical slots.

8. A device according to claim 7, wherein said engaging means is a support bolt extending between said support frame plates at the proximal end thereof, said support bolt being positioned to engage an upwardly open hook anchor.

9. A jump scaffolding comprising at least one self-actuating safety lock according to claim 6.

10. A jump scaffolding bracket according to claim 9, wherein said safety lock further comprises a pivot plate depending from said support frame and essentially the remainder of said scaffolding bracket is made from standard diagonals and standard metal walers, including beam walers horizontally joined to said lock by said fastening means and trailing walers, similarly joined to the pivot plate of said lock.

11. A device according to claim 10, wherein each lift connector further comprises a lifting link pivotally mounted on said lift bolt.

12. A jump scaffolding wallform combination, comprising jump scaffolding comprising at least two self-actuating safety locks according to claim 8, a gang wallform fastened at its lower end to said swivel gang jack means, and longitudinally adjustable diagonal bracing extending between the upper portion of said wallform and the distal end of said jump scaffolding such that said wallform can be stripped back from its pour position by shortening said diagonal bracing sufficiently to disengage said swivel jack means from said uplift stop means.

13. A system according to claim 12, further comprising a lifting lug means mounted on the upper end of said wallform and wherein said system is constructed and said lug means positioned such that with said wallform stripped sufficiently back a point can be reached where the lifting up on said lug means will both lift said swivel jack means thus unlocking said safety locks and also suspend said combination with said scaffolding generally in its normally oriented position.

14. A self-actuating safety lock mountable on liftable jump scaffolding for securing the latter to a holding device affixed to the side of a poured concrete wall, comprising locking means mountable on said jump scaffolding for engaging said holding device when said locking means combined with said scaffolding is lowered by a lifting device onto said holding device which thereby supports said scaffolding on said holding device and for locking onto said holding device when said combined locking means and scaffolding is unsupported by said lifting device and for unlocking from said holding device when said combined locking means and scaffolding is supported by said lifting device, and fastening means for mounting said locking means onto said scaffolding.

* * * * *